US006192943B1

(12) United States Patent
Griffith

(10) Patent No.: US 6,192,943 B1
(45) Date of Patent: Feb. 27, 2001

(54) CARPET LOOM FOR WEAVING WARP PILE FABRIC

(75) Inventor: John D. Griffith, Sunderland (GB)

(73) Assignee: GriffithTextile Machines Limited (GB)

( * ) Notice: Subject to any disclaimer, the term of this patent is extended or adjusted under 35 U.S.C. 154(b) by 0 days.

(21) Appl. No.: 09/489,165

(22) Filed: Jan. 21, 2000

(30) Foreign Application Priority Data

Jan. 21, 1999 (GB) ..... 9901211

(51) Int. Cl.[7] ..... D03D 39/20
(52) U.S. Cl. ..... 139/47
(58) Field of Search ..... 139/47, 46

(56) References Cited

U.S. PATENT DOCUMENTS

| | | | | |
|---|---|---|---|---|
| 2,057,615 | | 10/1936 | Hall . | |
| 2,414,064 | * | 1/1947 | Schulz et al. | 139/47 |
| 2,555,159 | * | 5/1951 | Schulz et al. | 139/47 |
| 3,450,167 | | 6/1969 | Lygo . | |
| 4,706,715 | * | 11/1987 | Murasaki | 139/47 |

FOREIGN PATENT DOCUMENTS 1059663 2/1967 (GB) .

* cited by examiner

*Primary Examiner*—Andy Falik
(74) *Attorney, Agent, or Firm*—Nikolai, Mersereau & Dietz, P.A.

(57) ABSTRACT

A loom for weaving pile fabric is disclosed, including a plurality of healds for shedding warp yarns, a pile-forming reed through which said warp yarns are guided and a plurality of pile loop forming lances extending in the warp direction so that each pile-forming lance passes through an associated dent in the read, each dent being defined between a pair of spaced apart dent fingers. Each loop forming lance and at least one dent finger of said pair of dent fingers cooperate to guide lateral displacement of the loop forming lance relative to said associated dent. A first group of healds are threaded with ground forming warp yarns and the first group of healds and the loop forming lances are arranged such that the upper and lower shedding positions of said ground forming warp yarns are located below the loop forming lances. A second group of healds are threaded with loop forming pile yarns, the second group of healds and said loop forming glances being arranged such that each loop forming yarn may be moved from a lower position located beneath an associated loop forming lance to an upper position located above said associated loop forming lance. A guide system is provided for guiding movement of each loop forming warp yarn such that during movement from its lower position to its upper position it passes by one side of said associated lance and during movement from its upper position to its lower position it passes by the opposite side of said associated lance to form a loop held upon said associated lance.

13 Claims, 11 Drawing Sheets

CARPET LOOM FOR WEAVING WARP PILE FABRIC

BACKGROUND OF THE INVENTION

I. Field of the Invention

The invention concerns the weaving of any pile fabric, but is particularly aimed at the weaving of a Wilton carpet.

II. Related Art

Briefly, in known looms of the class described, fabric is generally woven by raising and lowering a number of parallel threads which are known as "binding warps" relative to one another utilizing carrier frames known as "healds". A thread which forms the weft is passed across the warps in timed relation with the raising and lowering action to produce a woven backing or "base fabric". The pile portion is formed by raising and lowering pile forming warps in coordination with the weaving using additional healds which cooperate with the healds for the binding warps. The loops of pile are formed about oscillating pile wires or lances in a manner in which the pile forming warps are raised by healds working in coordination with the other healds for the binding warps and caused to pass to a selected side of the associated pile lances and are thereafter lowered by the healds and caused to pass to the other side of the pile lances thereby forming loops over the lances. After loop formation, the base fabric and the loops are pushed by a beater known as a "sley" along the pile lances against the already woven fabric to retain the pile yarn securely in the base fabric. This operation is known as "beating-up". Thereafter, the woven fabric is pushed further along the pile lances and the loops may be left or optionally cut open.

One such loom is illustrated and described in U.S. Pat. No. 3,450,167 in which the lances or pile wires are held stationary between adjacent spaced dent fingers while corresponding healds raise and lower the pile-forming warp to form loops about them. The pile forming warp threads must push past the pile wires along the dent fingers and displace them laterally as they are raised and lowered thereby running the added risk of a malfunction or thread breakage. Whereas such devices have been generally successful, it remains that improvements are needed in the coordination between dent fingers and the pile-forming wires or lances to more positively locate the lances with respect to the dents to that the pile-forming warp is more easily and positively guided around the desired side of the lance when being raised and lowered by the corresponding heald.

SUMMARY OF THE INVENTION

The invention concerns the weaving of any pile fabric, but is particularly aimed at the weaving of a Wilton carpet.

According to one aspect of the present invention there is provided a loom for weaving a pile fabric, the loom including a plurality of healds for shedding warp yarns, a pile forming reed through which said warp yarns are guided and a plurality of pile loop forming lances extending in the warp direction so that each pile forming lance passes through an associated dent in the reed, each dent being defined between a pair of spaced apart dent fingers, each loop forming lance and at least one dent finger of said pair of dent fingers co-operating to guide lateral displacement of the loop forming lance relative to said associated dent, a first group of said healds being threaded with ground forming warp yarns, said first group of healds and said loop forming lances being arranged such that the upper and lower shedding positions of said ground forming warp yarns are located below the loop forming lances, a second group of healds being threaded with loop forming pile yarns, the second group of healds and said loop forming lances being arranged such that each loop forming yarn may be moved from a lower position located beneath an associated loop forming lance to an upper position located above said associated loop forming lance, and guide means for guiding movement of each loop forming warp yarn such that during movement from its lower position to its upper position it passes by one side of said associated lance and during movement from its upper position to its lower position it passes by the opposite side of said associated lance to form a loop held upon said associated lance.

BRIEF DESCRIPTION OF THE DRAWINGS

Various aspects of the present invention are hereinafter described with reference to the accompanying drawings, in which.

The carpet comprises weft yarns 8 and warp yarns 1 which are woven to produce the ground weave, and warp yarns 5 which are woven into the ground weave to form the carpet pile.

Figure 1:
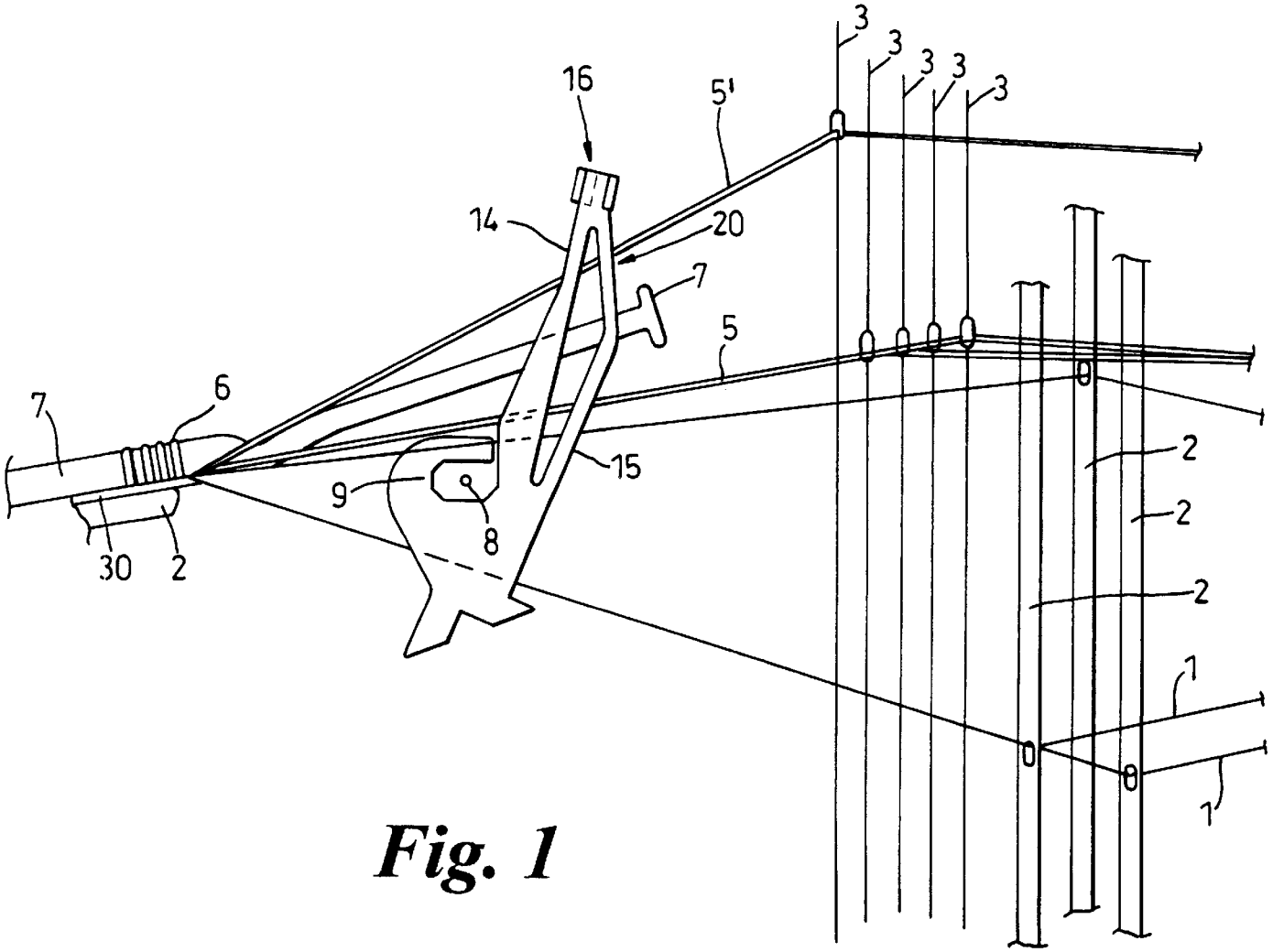
FIGS. 1 to 3 are schematic side views of a loom according to a first embodiment of the present invention shown at different stages during a weaving cycle.

In FIG. 1, the carpet 30 is pulled off in a forwards direction over the fell bar 2. The weft 8 is inserted by known means such as a projectile or rapier (not shown). In FIG. 1, a guide 9 for a projectile or rapier is illustrated. The ground warps 1 are raised and lowered by healds 2, which are preferably located in heald frames which are moved in a sequence to give the required carpet structure.

Pile warps 5 of different colours are raised and lowered typically from a Jacquard via healds 3. When a particular pile yarn is required to form a loop, shown as 5', it is raised higher than the others to a position above a pile loop forming finger or lance 7. The other pile yarns 5 are raised and lowered to shed positions below the lance 7 so as to be held in the ground weave.

Each pile loop forming finger or lance 7 passes through an associated reed dent 21 (FIG. 5) of a pile forming reed 16. In the first embodiment, the lance 7 is located by being held in the woven carpet by formed loops 6. It is restrained from backward movement by the function of the pile loops 6 which are trying to pull it forwards along the carpet. This forward motion is preferably halted by an abutment 32 located to the front of the reed 16 and which co-operates with the forward terminal end 71 of each lance 7. Preferably the abutment 32 is mounted so as to oscillate between abutment position 34 (shown in solid lines) and release position 33 (shown in broken lines) in synchronism with the weaving cycle, thus temporarily creating a gap for the pile loops 6 to slide off each lance 7 as the carpet 30 moves forward.

Preferably, as illustrated, the terminal end 71 of each lance 7 is inclined and the block 32 is arranged to oscillate along a path which is inclined at an acute angle relative to the longitudinal axis of each lance 7 such that when the abutment 32 acts to push each lance in a backwards direction the loops 6 located inbetween the abutment 32 and terminal end 71 of each lance 7 are compressed rather than stretched.

It will be appreciated, therefore, that during weaving, each lance 7 is in effect floating in the warp direction being prevented from moving in that direction by the abutment 32 and being constrained against lateral movement only by the loops 6 formed thereon.

Accordingly, at the start of weaving, lances 7 require lateral support until a sufficient number of loops 6 have been formed to hold each lance 7. This is preferably achieved by the use of a slotted bar (40 9FIG. 3) which is removed once a sufficient number of loops 6 have been formed.

Figure 2:
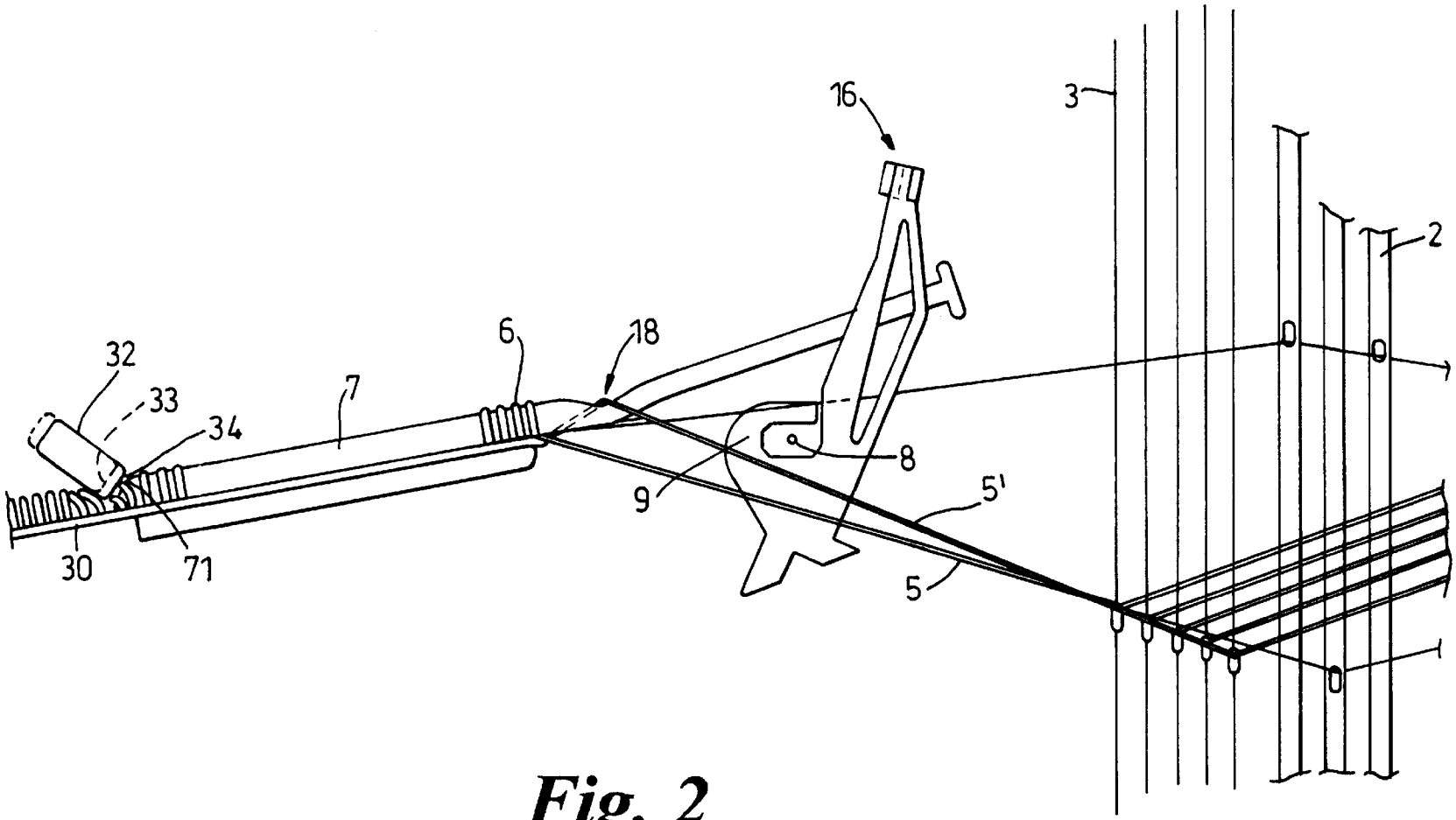
Figure 3:
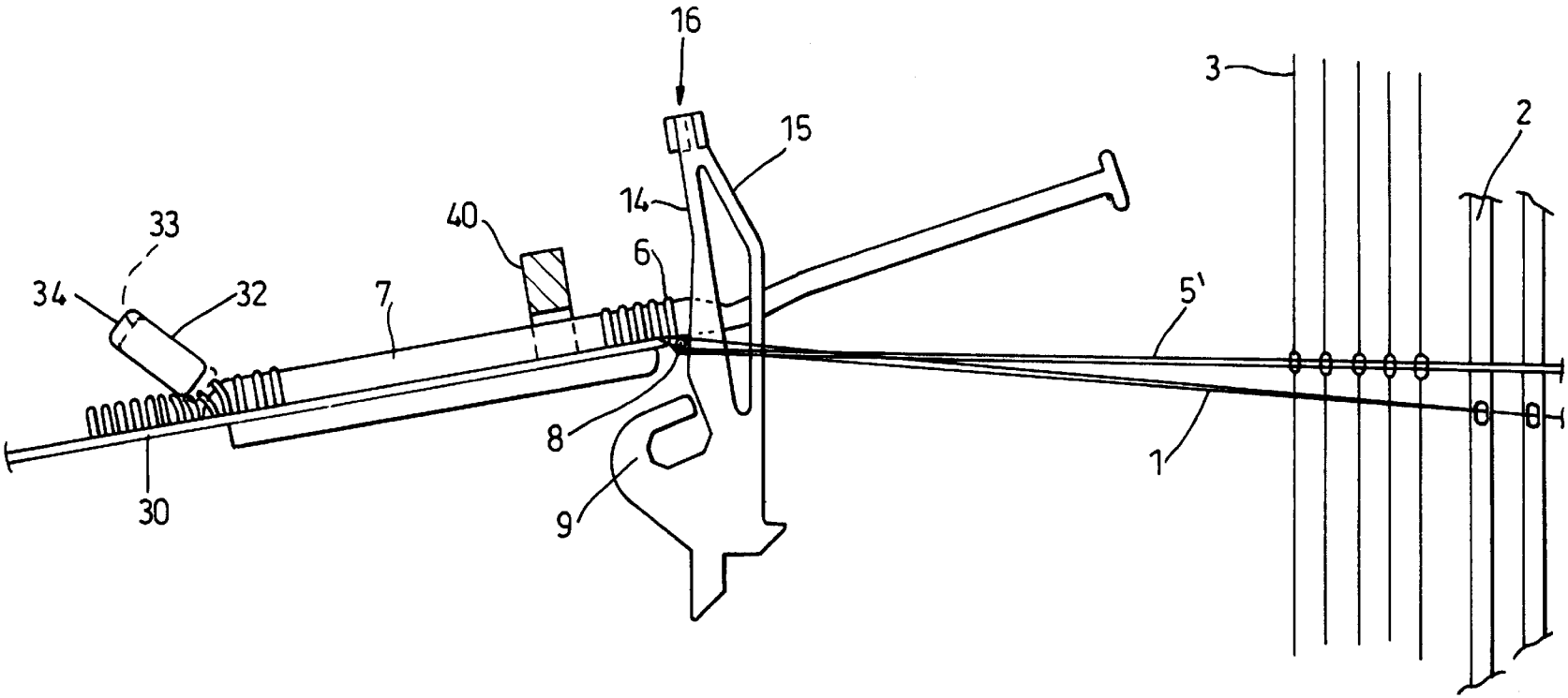
Figure 5:
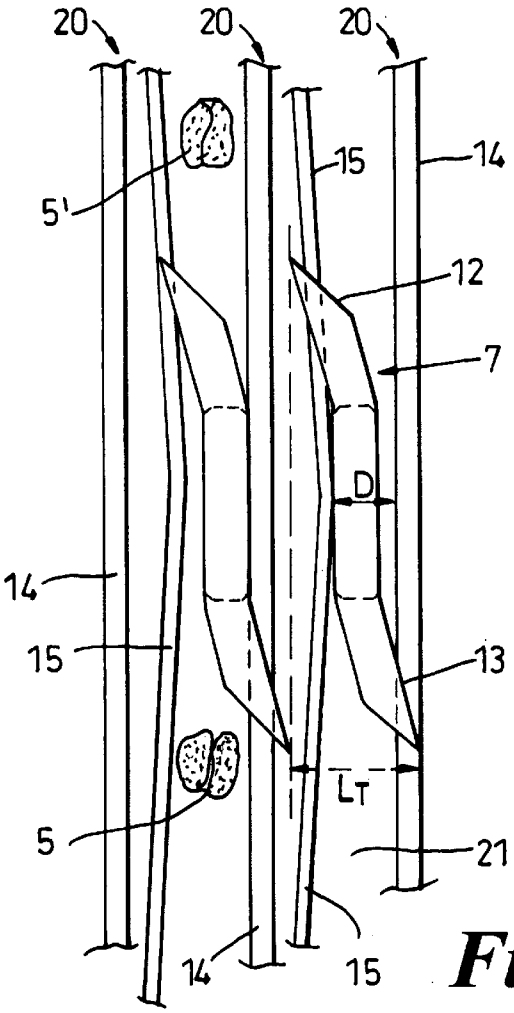
FIGS. 4 and 5 are respective side and end views of a pair of reed dents and a pile loop forming fmger of the first embodiment and illustrating passage of a pile loop forming warp yarn from its upper position above the pile loop forming lance to its lower position beneath the pile loop forming finger.
Figure 4:
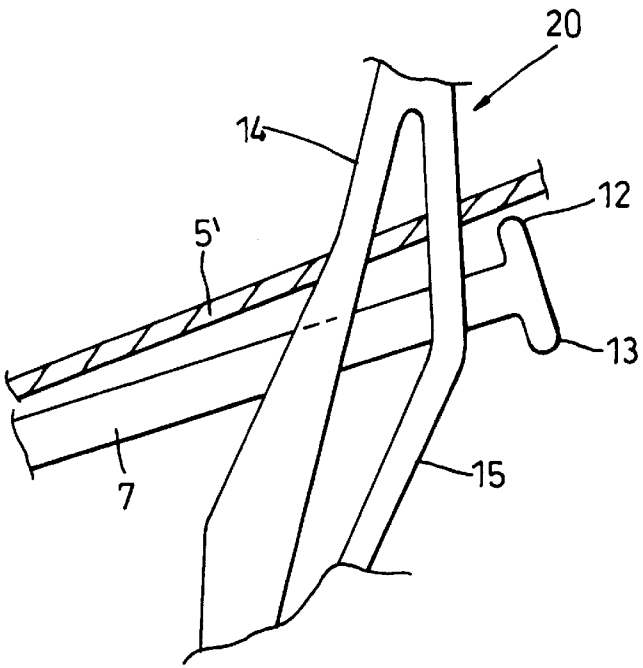

A pile loop 6 is formed round a lance 7 as shown in FIGS. 1 to 5. FIGS. 1, 4 and 5 show a yarn 5' having been raised to position above lance 7.

At the rearward end of each lance 7 there is provided a head which is defined by a pair of oppositely directed yarn guide abutments 12, 13 which in co-operation with the pair of dent fingers 20 defining the associated dent 21 cause the yarn 5' to pass one side of the lance 7 (left side as viewed in FIG. 5) during its passage to its position above the lance 7 and also cause the yarn 5' to pass the other side of the lance 7 (right side as viewed in FIG. 5) during its passage to a position below the lance 7.

Preferably each lance 7 is formed from a strip of a suitable metal, and the guide abutments 12, 13 are formed by bent portions. The lateral extent LT defined between the terminal ends of abutments 12, 13 is preferably the same or slightly greater than the minimum width D of the associated dent 21, but not so great as to project into the neighbouring dent 21.

To ensure that during loop formation the warp yarns 5 are reliably guided by a lance 7 in an associated dent 21 and are not engaged by lances 7 in adjacent dents 21, each lance 7 and at least one dent finger 20 of the associated dent 21 co-operate so as to positively guide lateral displacement of the lance 7 relative to the dent 21 such that at the time when warp yarn 5 contacts guide abutment 12 or 13 the lance 7 is positively located in a desired lateral position relative to the dent 21.

In the embodiment of FIG. 1, each reed finger 20 includes a front part 14 and a rear part 15. The width D of the dents 21 in the lower region of the reed is defined between front parts 14 and, in this region the width of the dent is relatively wide. The rear parts 15 are bent sideways (see FIG. 5) and so in effect reduce the width of each dent 21 to define a relatively narrow region of the dent since the dent space is then effectively defined between the front part 14 of one reed finger 20 and the rear part 15 of an adjacent reed finger 20.

The space between each rear part 15 and the opposed dent finger 20 with which it defines the dent 21 is preferably chosen so as to reduce or eliminate lateral movement of the lance 7 and also preferably the pile forming yarn 5.

If, as preferred, reed 16 acts as a beat-up reed the dent region defined between parts 14, 15 move into and out of registry with lances 7 as the reed moves between its rearmost position (FIGS. 1 and 2) and its beat-up position (FIG. 3).

Accordingly, parts 14, 15 may be relatively flexible to enable yarn 5 to pass between the lance 7 and opposed dent fingers whilst the reed is at a rear most position as shown in FIGS. 1 and 2 and the lances 7 and parts 14, 15 are in registry. Alternatively, parts 14, 15 may be relatively rigid and passage of the warp yarn 5 to one side or the other of the lance 7 may be achieved whilst the reed is in a region of movement where the lances 7 and parts 14, 15 are not in registry.

If the reed 16 is static (ie. it is additional to a beat-up reed), then parts 14, 15 need to be relatively flexible to permit passage of yarn 5 during loop formation.

In a typical weaving cycle the reed 16 (FIG. 1) beats up the weft 8 with the loop pile yarn 5' in its high position. When the reed returns (FIG. 2) the loop pile yarn 5' is lowered and wrapped round the lance 7 at 18. The next inserted weft 8 (FIG. 3) is pushed forward by the reed 16. When the reed 16 moves forward to beat-up the weft (FIG. 3), the weft 8 pushes the pile yarn forward to form a loop 6 in the carpet.

Figure 10:
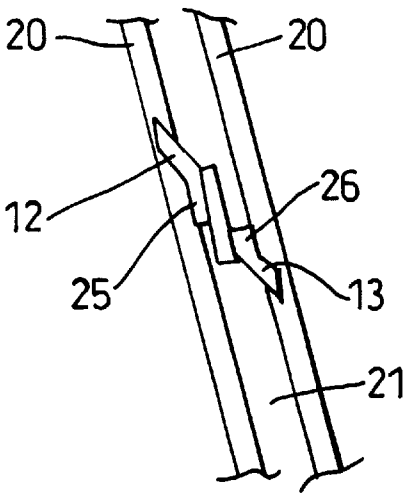
FIGS. 9 and 10 are respective side and end views of a dent and pile loop forming lance according to a fifth embodiment of the invention.
Figure 9:
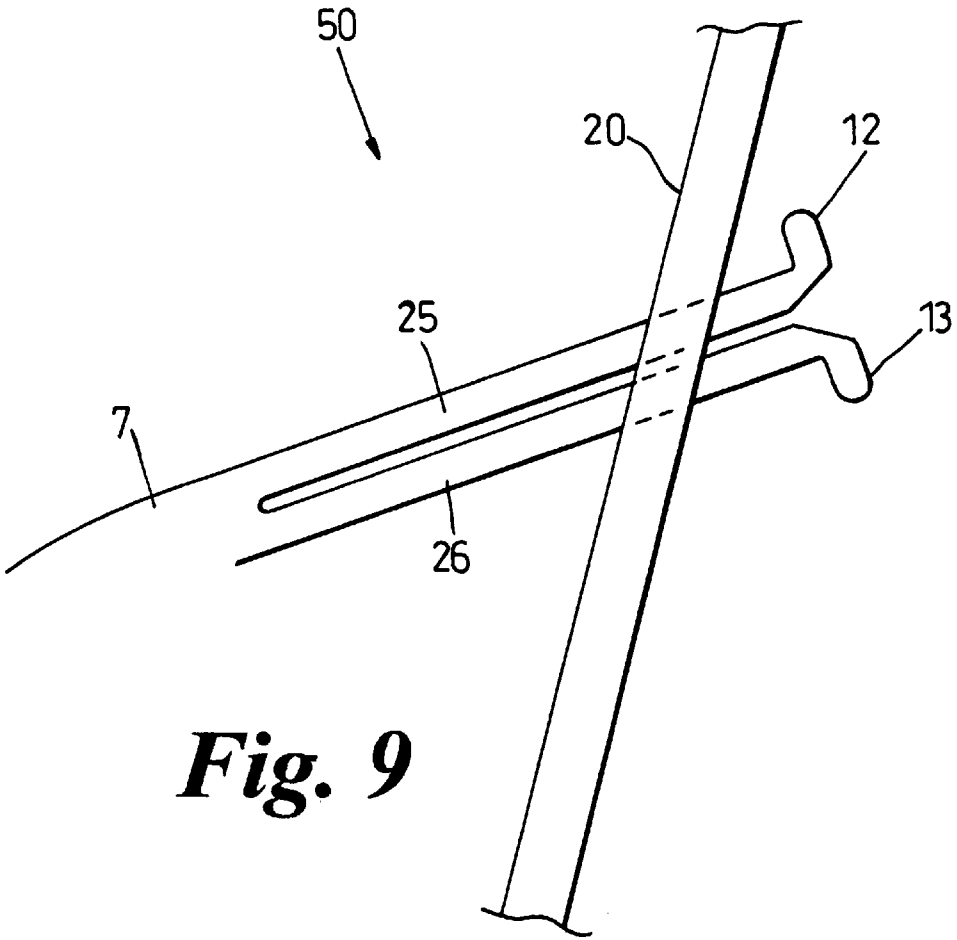

An alternative embodiment 50 is illustrated in FIGS. 9 and 10. In embodiment 50, the reed 16 is formed with dent fingers 20 which are straight and so define dents 21 having a width D which is the same from its upper to its lower region.

To provide guidance to each lance 7, each lance 7 adjacent to its rearward end is provided with a pair of arms 25, 26 of which upper arm 25 carries guide abutment 12 and lower arm 26 carries guide abutment 13.

Preferably both arms 25, 26 are bent to be laterally off-set from the remainder of the lance 7 and preferably contact opposed dent fingers 20 to laterally locate the position of the lance 7 relative to the dent 21.

As in the previous embodiment, if reed 16 is a beat-up reed, arm 25 and/or arm 26 may be relatively flexible or rigid. If reed 16 is static, then arm 25 and/or arm 26 needs to be relatively flexible to permit passage of yarn 5 during loop formation.

Figure 11:
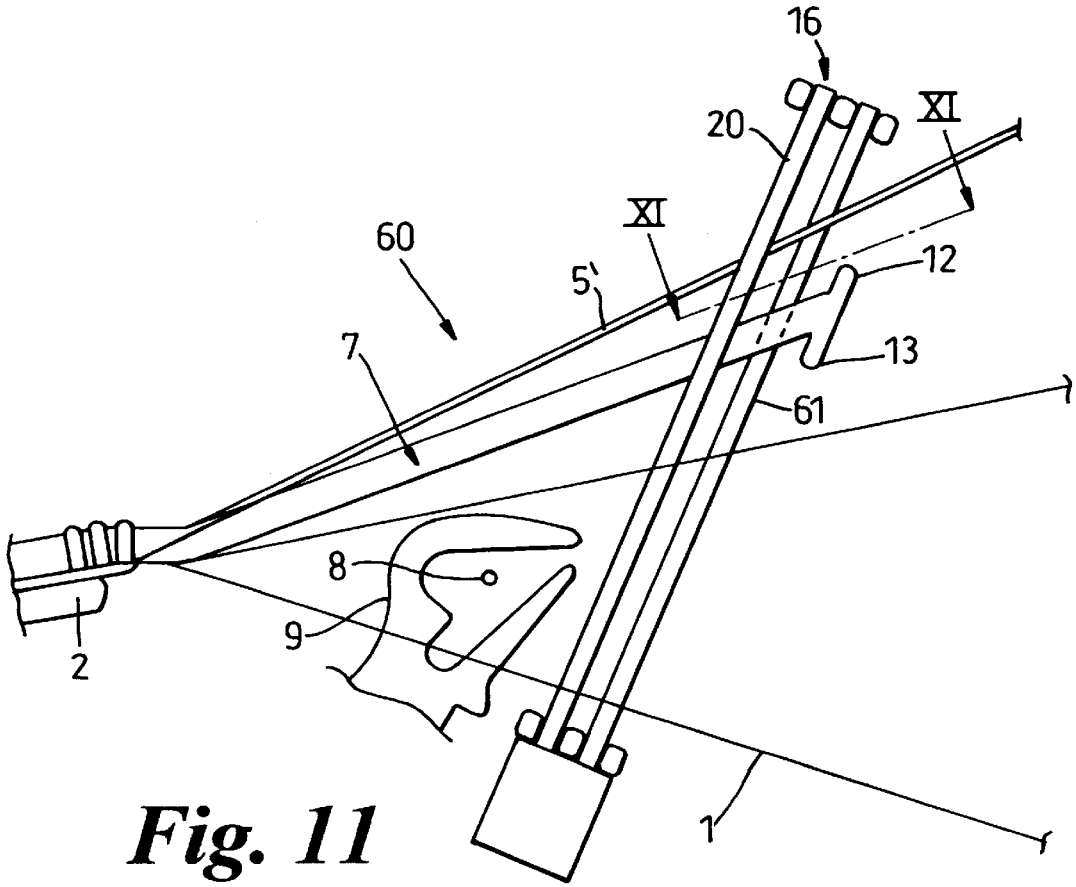
FIG. 11 is a schematic side view of a loom according to a sixth embodiment of the present invention.
Figure 12:
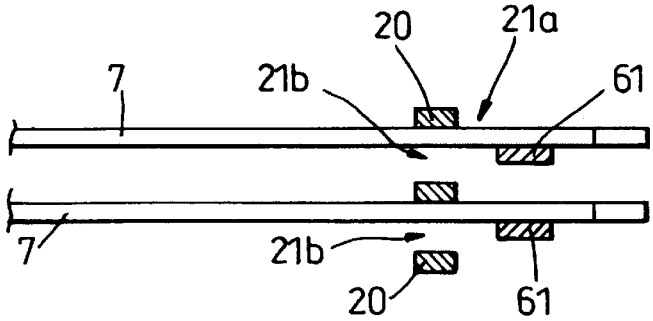
FIG. 12 is a part sectional view taken along XI—XI in FIG. 11.

A further alternative embodiment 60 is illustrated in FIGS. 11 and 12. In embodiment 60, an additional set of straight dent fingers 61 is provided for effectively dividing the dents 21 formed in reed 16 into two spaces 21*a*, 21*b*.

A lance 7 extends through space 21*a* between a dent finger 20 and dent finger 61 and is guided thereby. A yarn 5 for forming pile loops is also guided through dent space 21*a* (not shown).

Yarns 1 are preferably guided through dent spaces 21*b*.

Embodiment 60 enables straight dent fingers 20, 61 to be utilised and so is convenient to manufacture. Also by adjustable locating the reed made up of dent fingers 61 relative to the reed 16, it is possible to adjust the spacing dimension of spaces 21*a*. This enables different types of loop forming warp yarns, eg. textured and bulky yarns, to be accommodated for weaving.

Figure 13:
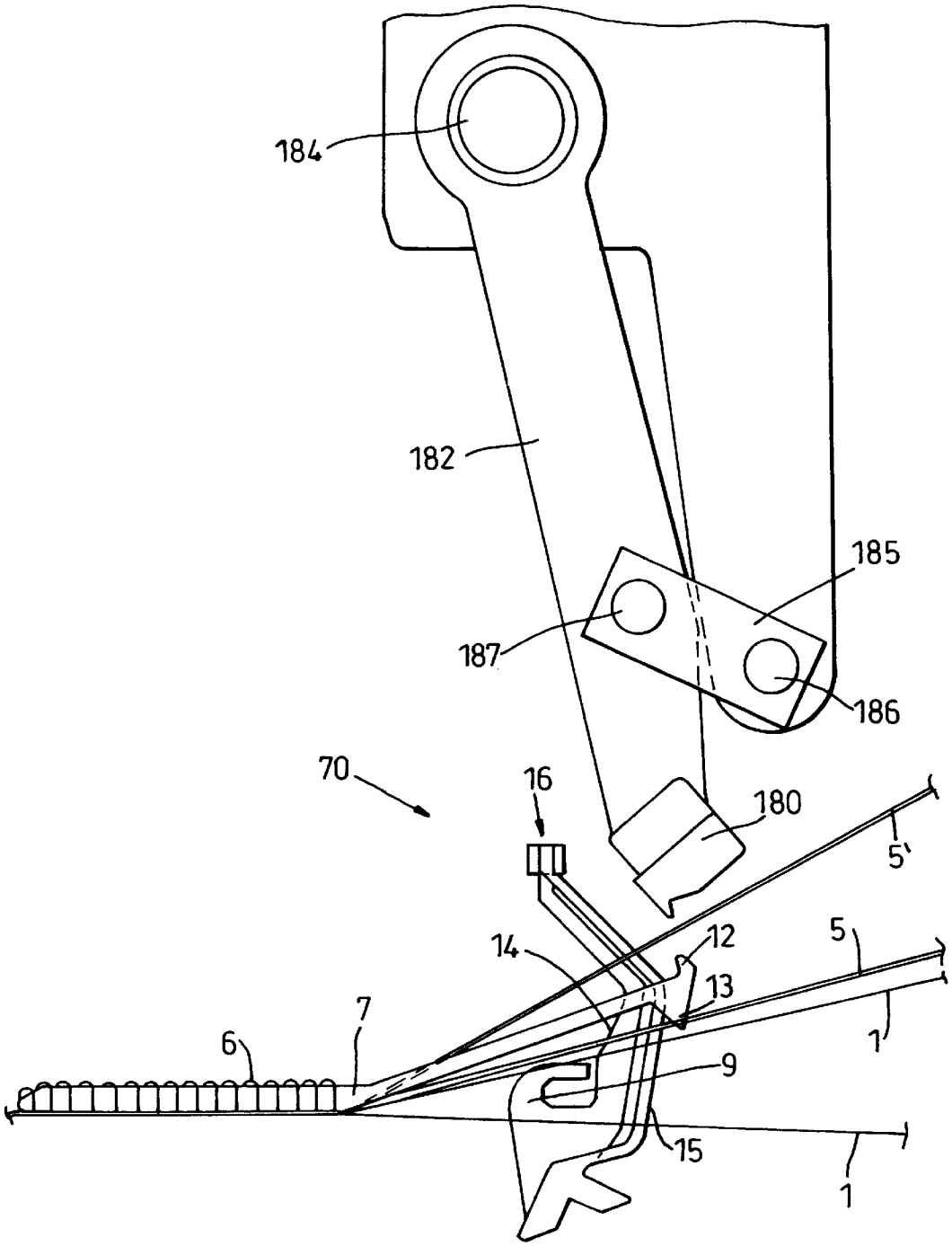
FIGS. 13 to 15 are schematic side views of a loom according to a seventh embodiment of the present invention shown at different stages during a weaving cycle.
Figure 14:
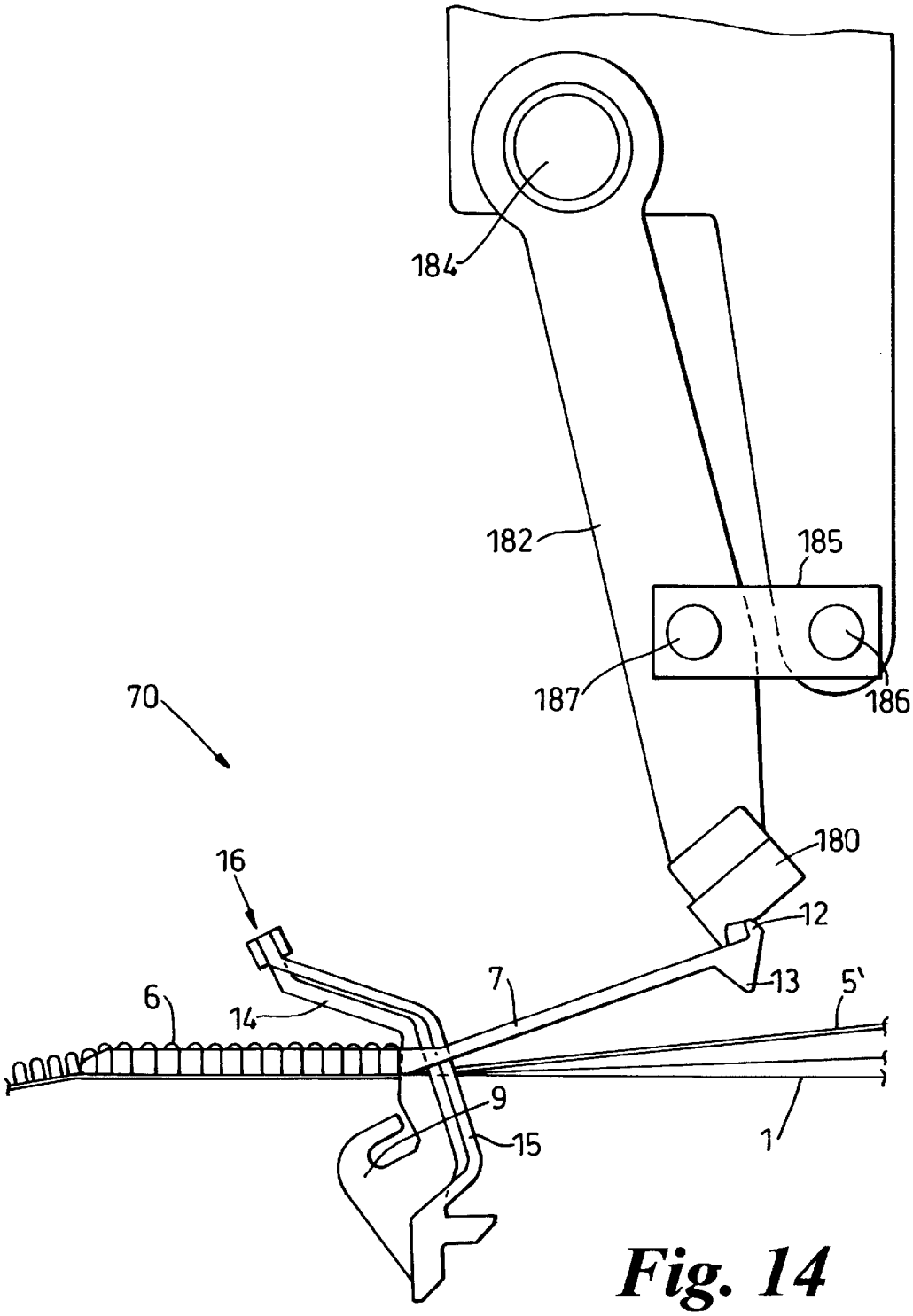
Figure 15:
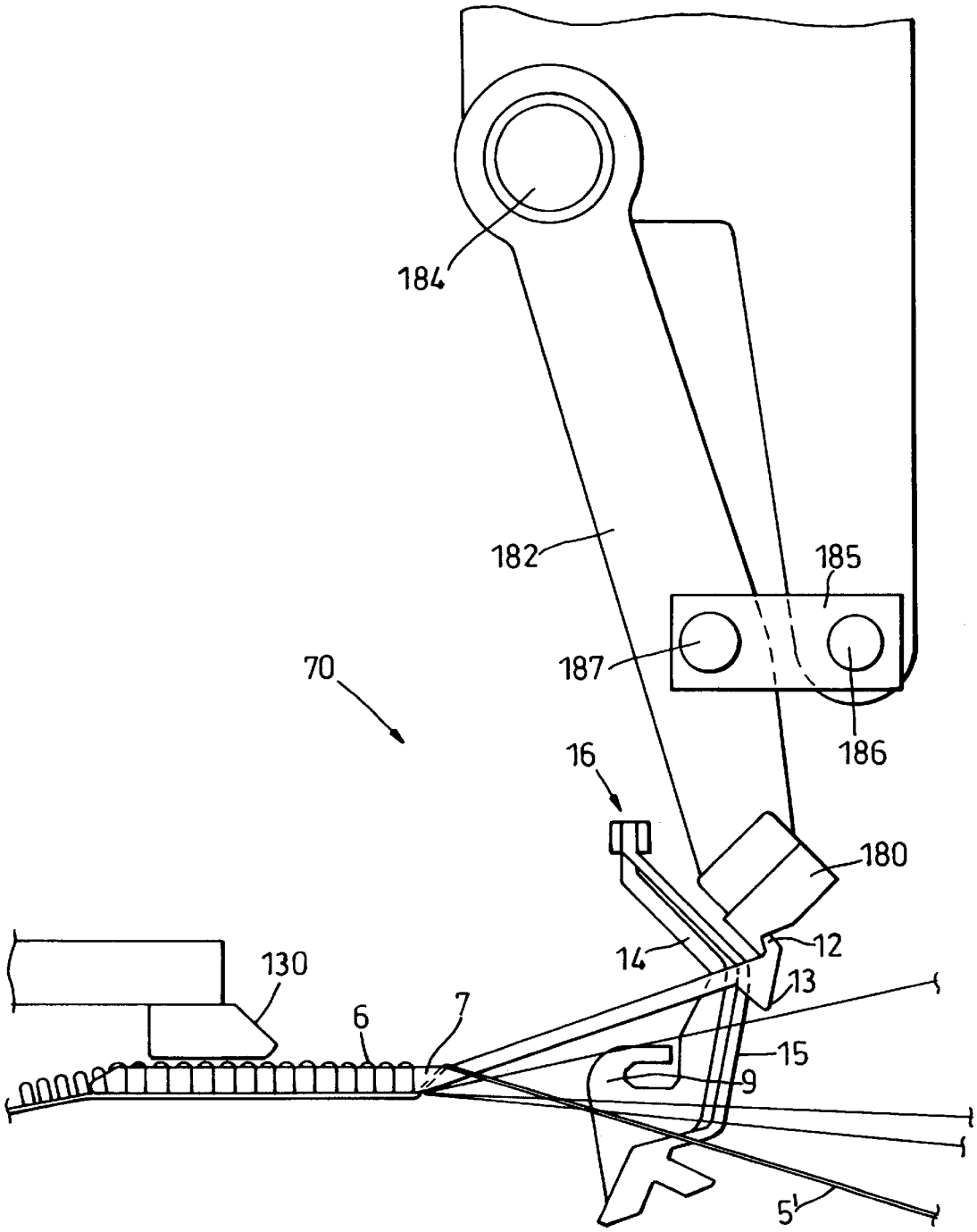

In the above embodiments, when producing looped pile, the lances 7 are restrained from moving in the forwards direction by an abutment 30. An alternative for constraining forward motion of the lances 7 is illustrated in FIGS. 13 to 15. This alternative is illustrated by reference to an embodiment 70 similar to that shown in FIG. 1, but it will be appreciated that this alternative is applicable to all the embodiments previously described.

In embodiment 70, the lances 7 are restrained from moving in the forward direction by an abutment bar 180 which is movably mounted on the loom frame at a position to the rear of the beat up read 16 to cyclically move into and out of engagement with the rearward end of the lances 7 during the weaving cycle.

The cyclic movement of the bar 180 is illustrated with reference to FIGS. 13 to 15.

In FIG. 13 the pile yarn 5' has been raised above a lance 7 and the beatup reed 16 is spaced away from the fell point. Also, as seen in FIG. 13, bar 180 is raised clear of the rearward head of each lance 7.

In FIG. 14, the reed 16 has moved forward toward the fell point to push a newly inserted weft yarn forwards. In addition the pile yarn 5' has been lowered below the lance 7 so as cross-over the lance 7.

The bar 180 has been lowered to a position in front of the upper abutment 12 in readiness to move rearwards in order to abut against the abutment 12.

In FIG. 15, the reed 16 has moved rearwardly whilst the pile yarn 5' has continued to be lowered. This enables a second weft yarn to be inserted above the pile yarn 5' in readiness for beat-up. As the reed 16 moves rearwardly, the bar 180 is also moved rearwardly to abut against the abutment 12.

The reed 16 then moves forwardly to beat-up the newly formed loop and weft yarns. At beat-up, the bar 180 is preferably in abutment with the abutment 12 of lance 7 and so prevents forward movement of the lance 7. After beat-up, as the reed 16 moves rearwardly, the bar 180 is raised out of contact with the lance to assume the position shown in FIG. 13.

Cyclic movement of the bar 180 is conveniently achieved by a pair of support arms 182 (only one being shown) which are connected at one end to the loom frame by a crank 184. A guide link 185 is pivotally connected at one end to the loom frame via a pivot 186 and at its other end to the support arm 182 by a pivot 187.

Preferably motive drive to the crank 184 is taken from the main drive shaft of the loom so that movement of the bar 180 is synchronised with movement of the reed 16.

Optionally, as shown in FIG. 15 a hold-down bar 130 may be provided located above the lances 7 in order to prevent them from rising during the weaving process.

In the above described embodiments the carpet 30 is woven so as to produce looped pile. It will be appreciated that carpet having cut pile may be produced also.

Figure 6:
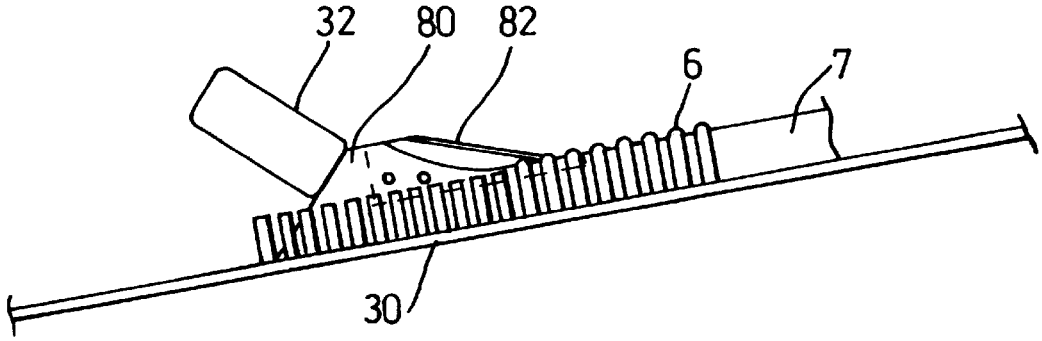
FIG. 6 is a part side view of a pile loop forming lancer according to a second embodiment of the present invention.
Figure 7:
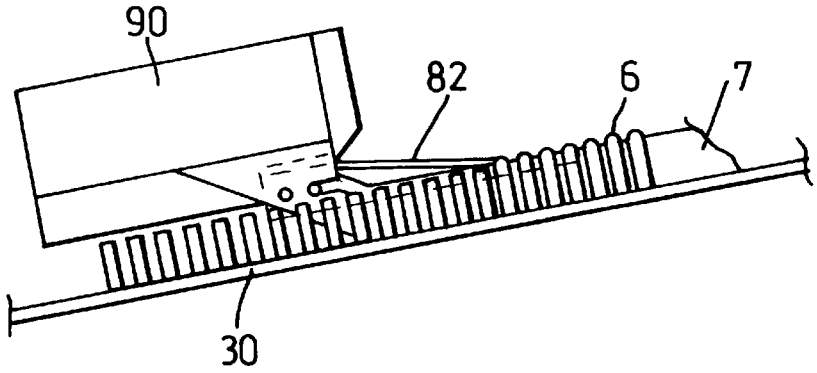
FIG. 7 is a part side view of a pile loop forming lance according to a third embodiment of the present invention.
Figure 8:
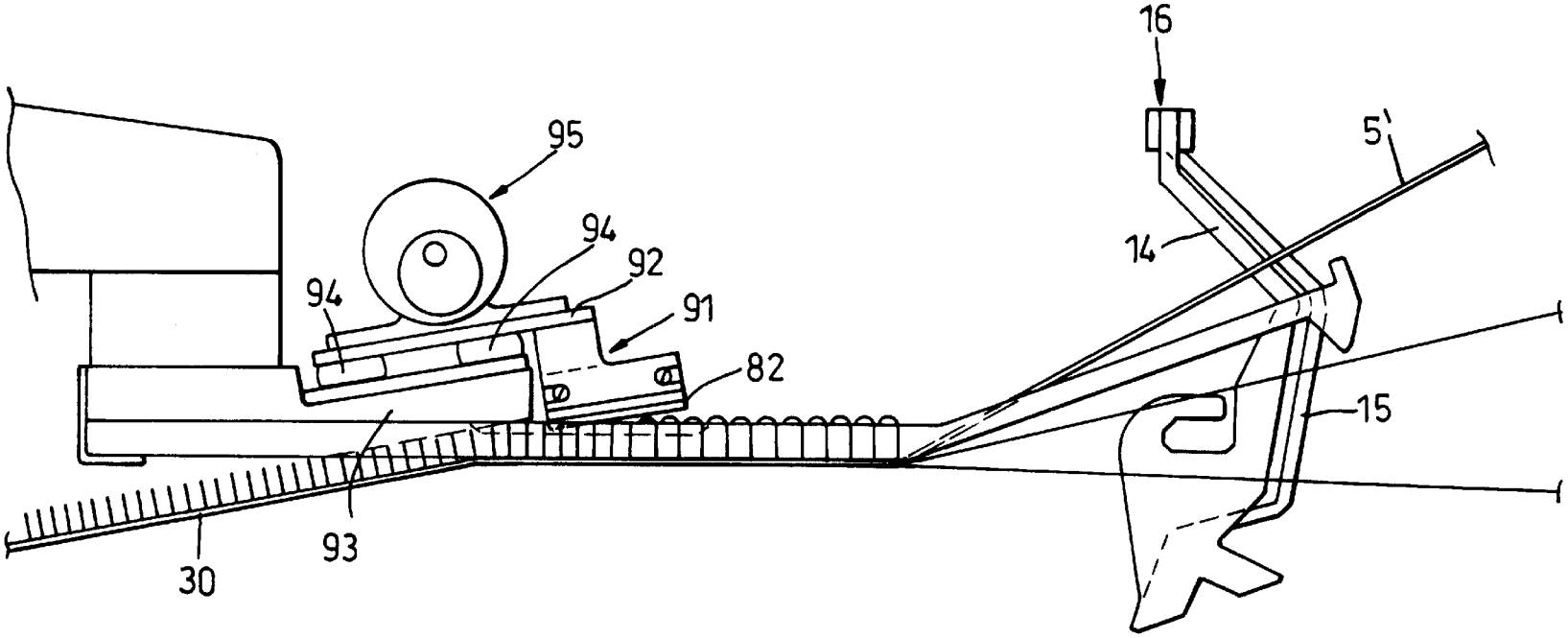
FIG. 8 is a part side view of a pile loop forming lance according to a fourth embodiment of the present invention.

In this respect, two alternative modifications are shown in FIGS. 6,7 and 8. These modifications apply to the lance 7 as described in relation to the embodiments described above.

In FIG. 6, each lance 7 is provided with a raised blade support block 80 which is arranged to abut against abutment 32. The support block 80 carries a blade 82 which cuts the loops 6 as the carpet 30 advances. The modification of FIG. 6 enables lance 7 (as per FIGS. 1, 9, 11 and 13) to be quickly and simply exchanged with lances 7 having blades 82.

When lances 7 having blades 82 are used, abutment 32 is preferably immobilised so as to remain static.

In the modification of FIG. 7, the lances 7 are secured to a frame member 90 of the loom and are thus positively secured in position. A blade 82 is provided for cutting the loops 6 as the carpet advances.

In FIG. 8 the cutter blade 82 is vibrated in order to provide a cleaner cut. This is achieved by mounting a blade carrier 91 on a platform 92 which is connected to a loom frame member 93 via resilient pads 94. A driven eccentric 95 is mounted on the platform 92 to cause it to vibrate. The frame member 93 preferably includes slots for accommodating the forward ends of the lances 7 in order to hold the lances 7 in spaced relationship.

It will be appreciated that by the provision of lances 7, reed 16 and abutment 32, or bar 180 existing looms can be easily converted so as to weave carpet (having looped or cut pile) in accordance with the present invention.

What is claimed is:

1. A loom for weaving a pile fabric comprising:

(a) a plurality of healds for shedding warp yarns;

(b) a pile forming reed through which said warp yarns are guided;

(c) a plurality of pile loop forming lances extending in the warp direction so that each loop forming lance has a rearward end that passes through an associated dent in the reed, each dent being defined between a pair of spaced apart dent fingers;

(d) wherein each loop forming lance and at least one dent finger of said pair of dent fingers co-operate to guide lateral displacement of the loop forming lance relative to said associated dent to positively locate the loop forming lance in a desired lateral position relative to the dent;

(e) wherein a first group of said healds is threaded with ground forming warp yarns, said first group of healds and said loop forming lances being arranged such that upper and lower shedding positions of said ground forming warp yarns are located below the loop forming lances;

(f) a second group of healds threaded with loop forming pile warp yarns, the second group of healds and said loop forming lances being arranged such that each loop forming yarn may be moved from a lower position located beneath an associated loop forming lance to an upper position located above said associated loop forming lance; and (g) a guide system associated with each loop forming lance for guiding movement of each loop forming pile warp yarn such that during movement from its lower position to its upper position it passes by one side of said associated lance and during movement from its upper position to its lower position it passes by the opposite side of said associated lance to form a loop held upon said associated lance.

2. A loom according to claim 1 wherein each lance is formed from a strip of metal and said guide system associated with each lance comprises a head portion at the rearward end ofsaid lance, the head portion including pile yarn guide abutments for guiding yarn to one side and the other side of the lance and wherein the pile yarn is raised and lowered relative to the lance.

3. A loom according to claim 1 wherein each dent has a relatively wide region and a relatively narrow region, the narrow region of the dent cooperating with a lance passing therethrough to control the lateral position of the lance.

4. A loom according to claim 3 wherein each dent finger includes a first part and a rear part, the rear part being more closely spaced to the front part of an adjacent reed finger so as to define said relatively narrow region of the dent.

5. A loom according to claim 2 wherein each dent has a relatively wide region and a relatively narrow region, the narrow region of the dent cooperating with a lance passing therethrough to control the lateral position of the lance.

6. A loom according to claim 2 wherein each lance includes a relatively wide portion for engagement with opposed dent fingers for guiding lateral displacement of the lance.

7. A loom according to claim 5 wherein each dent finger includes a first part and a rear part, the rear part being more closely spaced to the front part of an adjacent reed finger so as to define said relatively narrow region of the dent.

8. A loom according to claim 1 wherein each lance includes a relatively wide portion for engagement with opposed dent fingers for guiding lateral displacement of the lance.

9. A loom according to any one of claims 1–6 wherein the loom is adapted for weaving looped piles, each lance having a forward portion along which formed pile loops pass to slide off the forward end of the lance, said forward portion cooperating with said formed pile loops to retain the lance in position, and abutment means cooperating with the lances to restrain movement of the lances in a forward direction.

10. A loom according to claim 9 wherein said abutment means comprises a movable abutment member which co-operates with the lances at a position on the front of said pile forming reed.

11. A loom according to claim 9 wherein said abutment means comprises a moveable abutment member which cooperates the lances at a position to the rear of said pile forming reed.

12. A loom according to claim 9 wherein said pile forming reed constitutes the beat-up reed of the loom.

13. A loom according to any one of claims 1 to 6 wherein the loom is adapted for weaving cut-loop piles, said lance having a forward portion along which formed pile loops pass toward the forward end of the lance, and a cutting arrangement located adjacent to said forward portion to cut pile loops located thereon.

* * * * *